US006397528B1

(12) United States Patent
Rahimian

(10) Patent No.: US 6,397,528 B1
(45) **Date of Patent: *Jun. 4, 2002**

(54) COUPLED TRUSS SYSTEMS WITH DAMPING FOR SEISMIC PROTECTION OF BUILDINGS

(75) Inventor: Andrew Ahmad Rahimian, Forest Hills, NY (US)

(73) Assignee: The Cantor Seinuk Group, P.C., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,968

(22) Filed: Sep. 9, 1998

Related U.S. Application Data

(60) Provisional application No. 60/058,462, filed on Sep. 10, 1997.

(51) Int. Cl.[7] ..... E04H 9/02

(52) U.S. Cl. ..... 52/167.1; 52/167.3; 52/167.7; 52/167.8; 52/167.4

(58) Field of Search ..... 52/167.1, 167.3, 52/167.7, 167.8, 167.4

(56) References Cited

U.S. PATENT DOCUMENTS

| | | | | | |
|---|---|---|---|---|---|
| 2,053,226 | A | | 9/1936 | Ruge | |
| 3,418,768 | A | * | 12/1968 | Cardan | 52/167.1 |
| 4,577,826 | A | * | 3/1986 | Bergstrom et al. | 52/167.3 X |
| 4,799,339 | A | * | 1/1989 | Kobori et al. | 52/167.3 X |
| 4,890,430 | A | * | 1/1990 | Kobori et al. | 52/167.3 |
| 4,922,667 | A | | 5/1990 | Kobori et al. | |
| 5,065,552 | A | | 11/1991 | Kobori et al. | |
| 5,147,018 | A | | 9/1992 | Kobori et al. | |
| 5,152,110 | A | | 10/1992 | Garza-Tamez | |
| 5,271,197 | A | * | 12/1993 | Uno et al. | 52/167.1 |
| 5,347,771 | A | | 9/1994 | Kobori et al. | |
| 5,491,938 | A | | 2/1996 | Niwa et al. | |
| 5,727,663 | A | * | 3/1998 | Taylor | 52/167.1 X |

FOREIGN PATENT DOCUMENTS

| | | | | |
|---|---|---|---|---|
| AT | 1772335 | * | 10/1992 | 52/167.1 |
| JP | 405239953 A | * | 9/1993 | 52/167.3 |
| JP | 406307118 A | * | 11/1994 | 52/167.1 |

* cited by examiner

*Primary Examiner*—Carl D. Friedman
*Assistant Examiner*—Phi Dieu Tran A
(74) *Attorney, Agent, or Firm*—Kirschstein, et al.

(57) ABSTRACT

A multi-floor building is protected from seismic forces by coupling a damping system between a pair of truss columns of truss systems, each movable in a cantilever motion in response to the seismic forces to move opposite nodes of the damping system along an enhanced working stroke as compared to prior art frame constructions.

4 Claims, 7 Drawing Sheets

COUPLED TRUSS SYSTEMS WITH DAMPING FOR SEISMIC PROTECTION OF BUILDINGS

CROSS REFERENCE TO RELATED APPLICATIONS

This application claims the priority of provisional application Ser. No. 60/058,462, filed Sep. 10, 1997.

BACKGROUND OF THE INVENTION

1. Field of the Invention

This invention generally relates to a system for, and a method of, reducing deflections, vibrations and internal stresses in an upright structure, such as a high-rise, multi-floor building, exposed to external forces, such as earthquakes, winds and air bursts and, more particularly, to economically increasing the capability of the building from withstanding such disastrous conditions.

2. Description of the Related Art

It is known in the art of building construction to incorporate both active and passive dampers in a frame for absorbing deflections and vibrations caused by seismic disturbances. See, for example, U.S. Pat. Nos. 2,053,226; 3,418,768; 4,922,667; 5,065,552; 5,147,018; 5,152,110; 5,347,771; and 5,491,938.

FIG. 1 of the accompanying drawings is representative of such known frame constructions, wherein a high-rise, multi-floor building 10 is constructed of generally vertical columns 12 vertically stacked one above another, generally horizontal beams 14 connected to the columns in mutual parallelism, and dampers 16 mounted in generally diagonal damping braces 18. Each damper resembles an automobile shock absorber in that it typically consists of a piston slidable in a cylinder in which a viscous fluid, typically an inert operating fluid, such as silicone, is contained. Friction dampers could also be used.

As shown in FIG. 1, the building 10 is built on a foundation 20. Upon exposure to a seismic force, the building experiences deflections, vibrations and stresses. Each beam and column exhibits a localized flexing or bending movement or distortion. The damper absorbs energy as a function of the relative velocity and movement of the piston as dictated by the velocity and movement of the neighboring beams and columns.

A simplified model for each of the floors shown in FIG. 1 is depicted in FIG. 2, wherein F(t) represents the seismic force, and wherein springs 22 have been added to represent the effect of the axial flexibility of the stacked columns supporting the model at a level h above the ground 20. One of the nodes N has been separately identified to aid the following description.

The inter-story lateral displacement $U_x$ and the lateral velocity $U_x'$ between the top and bottom of a column 12 are composed of two components. The first is based on the equivalent shear deformation ($U_{vx}$, $U'_{vx}$) i.e., local bending and shear deformation of the beams and columns, as well as the axial deformation of the diagonal damping braces. The second is based on the rocking component of deformation ($U_{ax}$, $U'_{ax}$), i.e., the rotation created by the axial deformation of the stacked columns. This can be expressed by the following equations:

$$U_x=U_{ax}+U_{vx} \tag{1}$$

$$U'_x=U'_{ax}+U'_{vx} \tag{2}$$

Only the equivalent shear components $U_{vx}$ and $U'_{vx}$ contribute to the displacement and the velocity of the damper 16. Thus, $U_{vx}$ and $U'_{vx}$ are derived from equations (1) and (2) as follows:

$$U_{vx}=U_x-U_{ax} \tag{3}$$

$$U'_{vx}=U'_x-U'_{ax} \tag{4}$$

The effectiveness of the damper 16 is directly related to $U'_{vx}$ and $U_{vx}$. As the contribution of $U'_{ax}$ and $U_{ax}$ increases for a constant $U_x$ and $U'_x$, the value of $U'_{vx}$ and $U_{vx}$ decreases. This effect is more pronounced at the upper levels of a high-rise building, where the axial deformation of the stacked columns is at its maximum. Thus, the effectiveness of the dampers is reduced at the upper levels of a high-rise building for a constant inter-story sway of the building.

The relationships above could also be explained by considering the angular rotation and velocity of the node N shown in FIG. 3. The damper force and absorbed energy are functions of the degree of distortion of the damping brace as shown in FIG. 3. The damping brace distortion could be measured by the internal angle β between the beam and column joining at node N. From FIG. 3, the following equations are obtained:

$$\alpha_v+\beta=90° \tag{5}$$

$$\alpha_v=\alpha-\alpha_a \tag{6}$$

wherein α is the angular displacement of the column 12 from the vertical or rest position, wherein $\alpha_a$ is the angular displacement of the beam 14 from the horizontal or rest position, and wherein $\alpha_v$ is the measure of the distortion of the internal angle β. These relationships are compared to this invention below.

SUMMARY OF THE INVENTION

OBJECTS OF THE INVENTION

It is the general object of this invention to protect a multi-floor, high-rise, building from external events, such as earthquakes, high winds, and air bursts by minimizing structural deflections caused by such events.

It is another object of this invention to retrofit existing buildings, or to build new buildings, with such protection.

It is still another object of this invention to protect occupants of such buildings from injury, especially in the case of seismic events.

FEATURES OF THE INVENTION

In keeping with these objects and others which will become apparent hereinafter, one feature of this invention resides in coupling a damping system between a pair of upright truss systems that are spaced apart from each other. Each truss system has a truss column, a lower end region fixedly secured to the ground or foundation, and an upper free end region that is movable against resistance in a transverse oscillatory cantilever motion in response to external forces, such as seismic forces. Each truss system exhibits, as its dominant action, a cantilever movement against a rather significant structural resistance to lateral force.

In accordance with this invention, the effectiveness of the damping system is increased over prior art constructions by reversing the directions of the axial movement and velocity of the truss columns connected to the damping system. The damping system may, in a simple embodiment, include a single damper having opposite ends connected at nodes to the truss columns and movable relative to each other. During cantilever movement of one of the truss systems, the node connected to one of the damper ends moves in one direction, for example, upwardly, while the node connected to the other of the damper ends is connected to the other of the truss systems and moves in an opposite direction, i.e., downwardly. The axial deformation of the truss columns is enhanced over prior art constructions. This enhanced deformation causes the nodes connected to the columns to move through a longer relative distance and, in turn, a damper element of the damper to move through an enhanced working stroke.

In the preferred embodiment, each truss system includes, for each floor of the building, a pair of generally vertical, elongated columns, a pair of generally horizontal, elongated beams connected to the columns at corner regions, and a generally diagonal, elongated, stiffening brace connected at opposing corner regions to the columns and beams. Alternatively, or in addition, each truss system could include a solid wall of substantial width extending along the foundation, for example, a poured concrete wall extending over a substantial distance across the ground could exhibit the desired cantilever action according to this invention.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 4A:
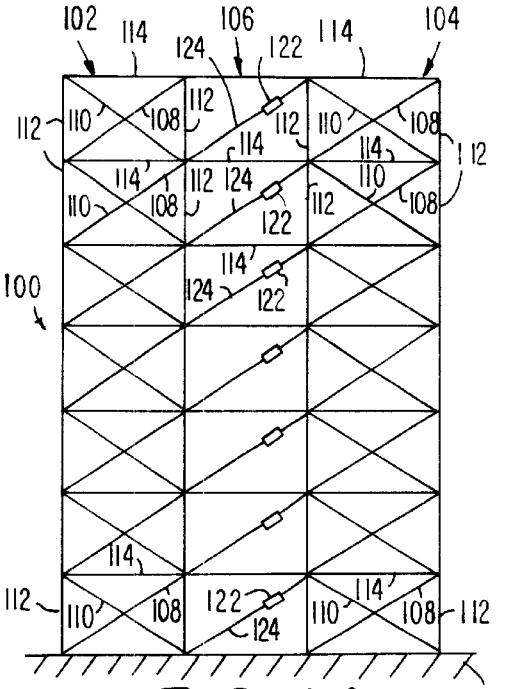
FIG. 4A is a view analogous to FIG. 1, but of one embodiment in accordance with this invention.
Figure 4C:
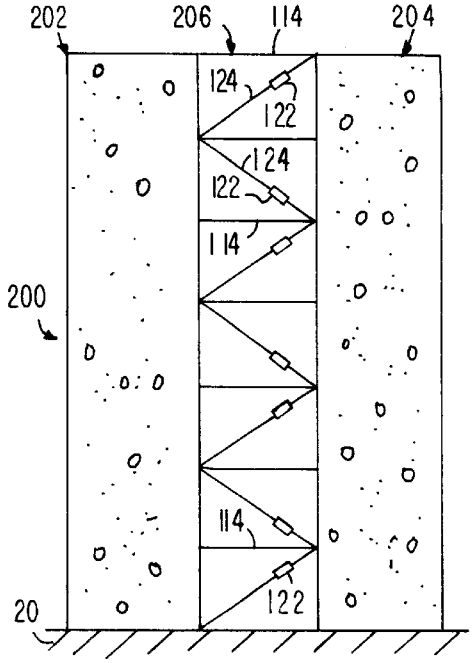
FIG. 4C is a view analogous to FIG. 1, but of still another embodiment in accordance with this invention.
Figure 4B:
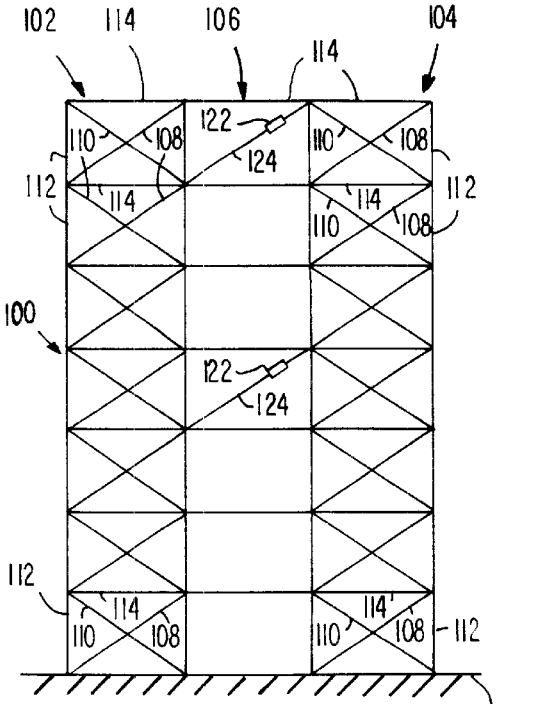
FIG. 4B is a view analogous to FIG. 1, but of another embodiment in accordance with this invention.

Referring now to FIGS. 4A and 4B of the drawings, reference numeral 100 generally identifies a high-rise, multi-floor building constructed of two truss systems 102, 104 spaced apart from each other, and a damping system 106 coupled between the truss systems.

Each truss system 102, 104 includes generally vertical columns 112 stacked vertically one above another, generally horizontal beams 114 spanning and connecting the columns in mutual parallelism, and at least one diagonal stiffening brace and, as shown, two criss-crossed stiffening braces 108, 110 extending along diagonals between the columns and the beams for each floor of the building. The lower end region of each truss system is fixedly secured to the foundation or ground 20. The upper free end region of each truss system is movable against a substantial resistance in a transverse oscillatory cantilever motion in response to external forces, as described below.

The damping system 106 includes at least one damper 122 and, as shown in FIG. 4B, two dampers on spaced apart floors and, as shown in FIG. 4A, a damper on each floor. Each damper includes, in the preferred embodiment of a viscous damper, a piston, preferably of hardened, hand-polished, stainless steel coated with Teflon™, and a cylinder, also constituted of a hardened stainless steel. An inert operating fluid, such as silicone, is accommodated in the cylinder, the fluid having a flashpoint in excess of 600° F. and thus classified as nonflammable and noncombustible. The silicone is a pure fluid polymer that cannot settle out or break down into components. The cylinder is sealed to prevent oxidation of the silicone. Various working strokes are available depending on the magnitude of the force applied to opposite ends of the damper.

Each damper 122 has opposite ends, one at one end of the piston, and the other at an opposite end of the cylinder, connected in and between portions of an elongated damping brace 124 that, as shown, in FIG. 4A, extends along a diagonal for each floor between the truss systems. Additional beams 114 extend between the truss systems on each floor.

Figure 4D:
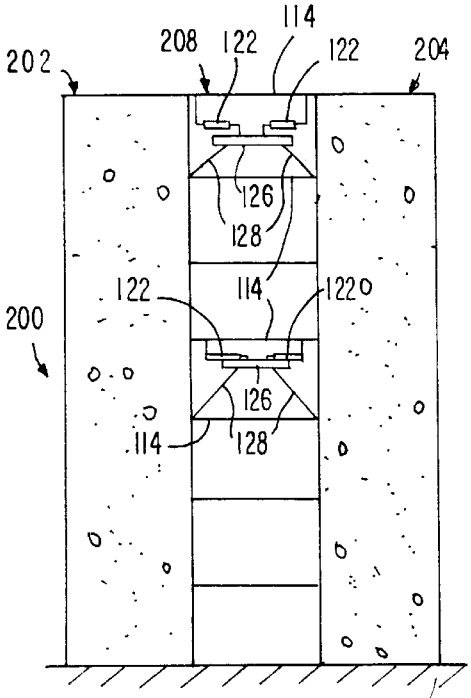
FIG. 4D is a view analogous to FIG. 1, but of yet another embodiment in accordance with this invention.

A different truss system is depicted in FIGS. 4C and 4D, wherein a building 200 is constructed of two truss systems 202 and 204, again spaced apart from each other. A damping system 206 is coupled between the truss systems in FIG. 4C, wherein each truss system 202, 204 is a mass of solid material, e.g., concrete, that extends along the foundation for a substantial distance so that each truss system moves in a cantilever motion against substantial resistance when exposed to seismic forces, as described below.

The damping system 206 is analogous to the damping system 106, except that the diagonal damping braces 124 in FIG. 4C change direction on alternate floors. Horizontal beams 114 extend between the truss systems on each floor above and below each damper 122.

A different damping system 208 is coupled between the truss systems 202 and 204 in FIG. 4D. Rather than a single damper 122 located along a diagonal brace 124, a pair of dampers 122 is arranged along a horizontal plane above a table 126 having diagonal legs 128. One end of each damper 122 is connected to the table 126. The opposite end of each damper 122 is connected to an overhead beam 114. Other damping system configurations are contemplated by this invention. For example, friction dampers, visco-elastic dampers and, in brief, any force-velocity sensitive damper could be used.

Figure 4E:
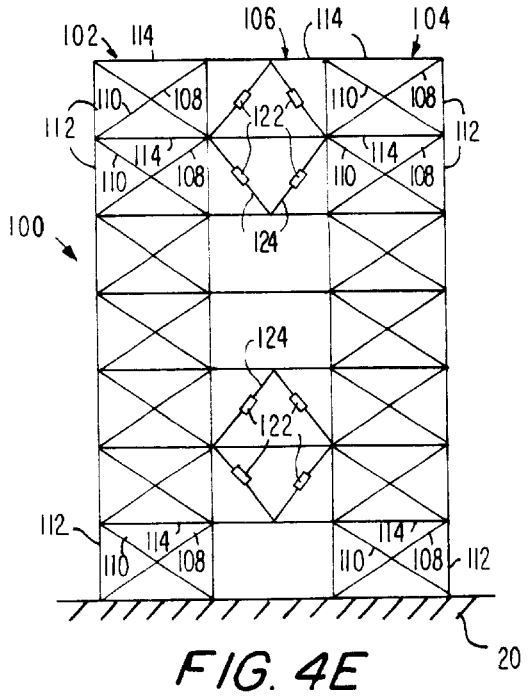
FIG. 4E is a view analogous to FIG. 1, but of a currently preferred embodiment in accordance with this invention.

FIG. 4E illustrates a currently preferred embodiment in which a pair of dampers is located on one floor, and another pair of dampers is located on an adjacent floor, both pairs being arranged in a parallelogram arrangement that is mirror symmetrical relative to a horizontal beam 114 between the pairs. Another parallelogram arrangement is located on a pair of lower floors spaced several floors away from the first parallelogram arrangement.

Figure 1:
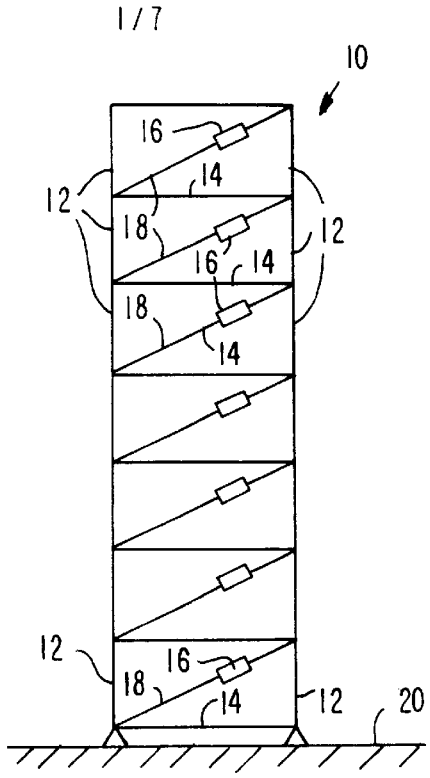
FIG. 1 PRIOR ART
FIG. 1 is a simplified schematic elevational view of a high-rise, multi-story building equipped with dampers in accordance with the prior art.
Figure 2:
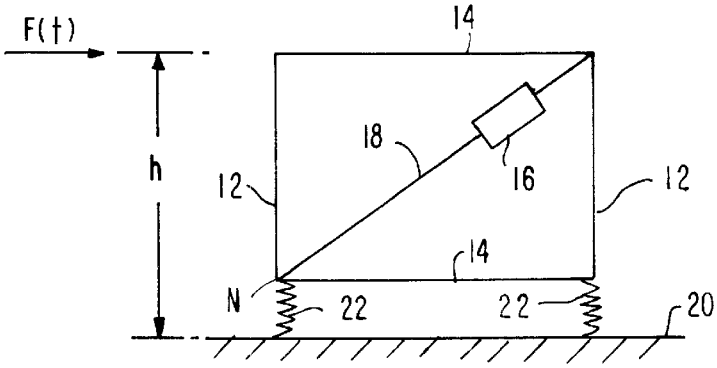
FIG. 2 PRIOR ART
FIG. 2 is a simplified model of one floor of the building of FIG. 1 according to the prior art.
Figure 5:
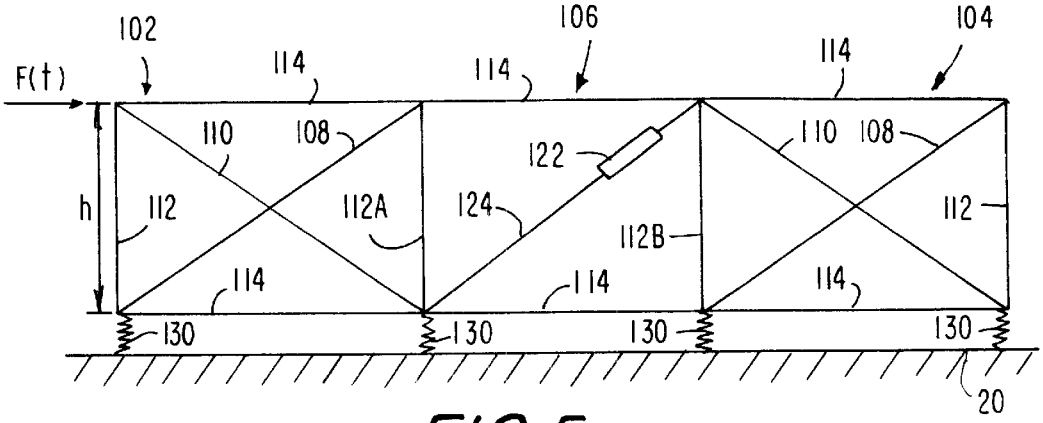
FIG. 5 is a view analogous to FIG. 2 in accordance with this invention.

Returning to the simplified damping system depicted in FIG. 4A, a system model analogous to that shown in FIG. 2 is illustrated in FIG. 5. Again, F(t) represents the seismic force, and springs 130 have been added to represent the effect of the axial flexibility or deformation of the stacked columns supporting the model at a level h above the ground 20. To aid the following description, the truss columns to which the damping system 106 are directly connected are identified by the reference designations 112A, 112B.

Figure 6:
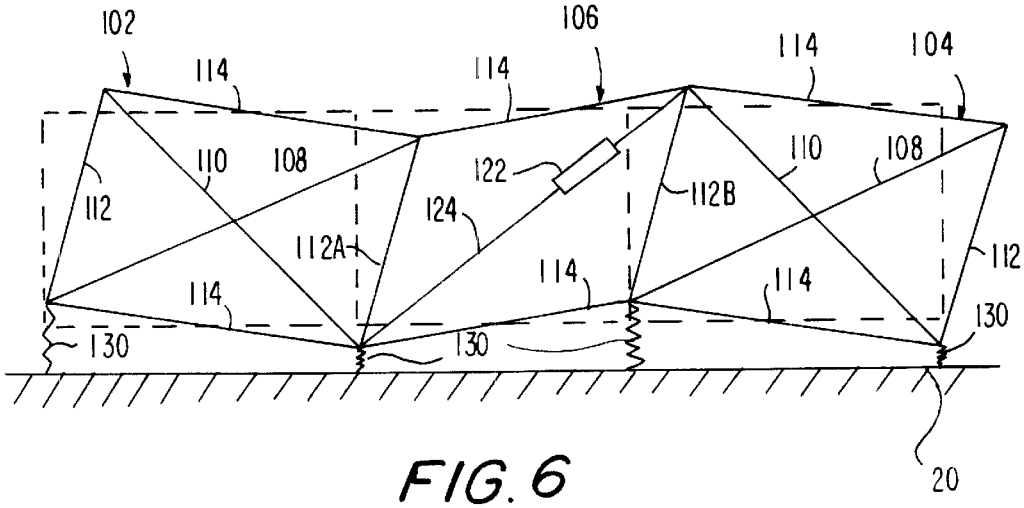
FIG. 6 is a view of FIG. 5 in response to a seismic force.

FIG. 6 depicts the essential behavior of the model of FIG. 5 in response to the seismic force. The truss system 102 moves in a cantilever motion so that the truss column 112A is axially compressed or foreshortened, as depicted by the compression of the spring 130 underneath the stacked column 112A. At the same time, the truss system 104 also moves in a cantilever motion so that the truss column 112B is axially stretched or lengthened, as depicted by the stretch of the spring 130 underneath the stacked column 112B. Thus, the stacked columns 112A, 112B are displaced in different directions which is in contrast to the prior art model of FIG. 2, wherein the columns 12 adjacent the damper 16 experience only localized deformation. Hence, the differential movement and velocity of the truss columns 112A, 112B increases the net differential movement and velocity of the damper 122.

Figure 3:
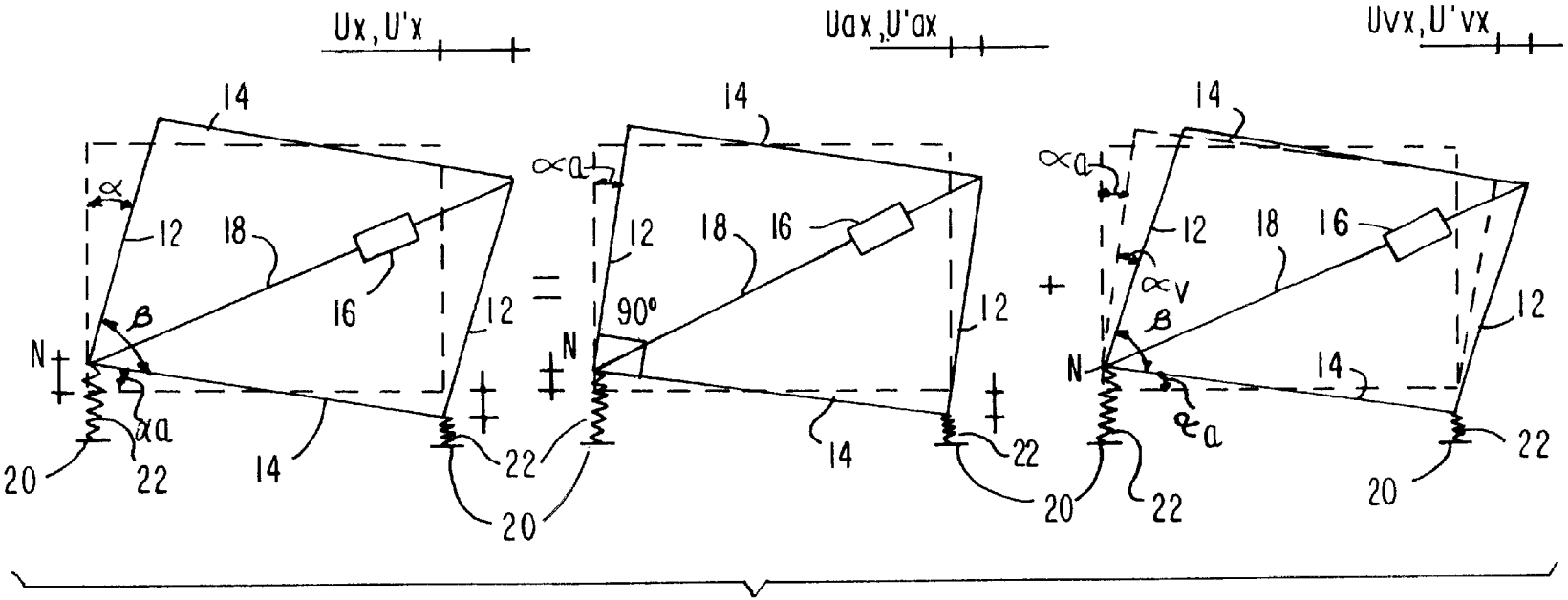
FIG. 3 PRIOR ART
FIG. 3 is a diagram of the model of FIG. 2 showing components of its movement in response to external forces according to the prior art.
Figure 7:
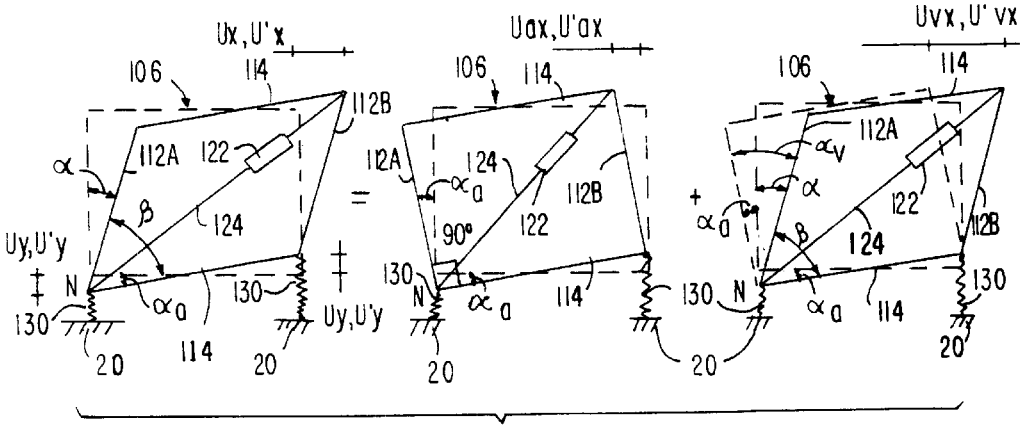
FIG. 7 is a view analogous to FIG. 3 in accordance with this invention.

FIG. 7 is analogous to FIG. 3 and, using a similar analysis, the lateral displacement $U_x$ and the lateral velocity $U'_x$ are expressed by the following equations:

$$U_x=U_{vx}-U_{ax} \tag{7}$$

$$U'_x=U'_{vx}-U'_{ax} \tag{8}$$

Therefore, $$U_{vx}=U_x+U_{ax} \tag{9}$$

$$U'_{vx}=U'_x+U'_{ax} \tag{10}$$

The relationships above could also be explained by considering the angular rotation and velocity of $\alpha$, $\alpha_a$, $\alpha_v$, and $\beta$ as shown in FIG. 7. The damper force and absorbed energy are functions of the degree of distortion of the damping brace as shown in FIG. 3. The damping brace distortion could again be measured by the internal angle $\beta$ between the beam and column joining at node N. From FIG. 7, the following relationships could be obtained:

$$\alpha_v+\beta=90° \tag{11}$$

$$\alpha_v=\alpha+\alpha_a \tag{12}$$

Another way of demonstrating the difference between the instant invention and the prior art can be seen by comparing equations 4 and 10 in lateral displacement terms, as well as by comparing equations 6 and 12 in angular rotation terms.

In the prior art, the term $U'_{ax}$ reduces the term $U'_{vx}$ and the damper velocity for a given $U'_x$ due to the rigid body rotation of the damping brace 18 in the direction of $U'_x$ movement.

However, in accordance with this invention, the term $U'_{ax}$ increases the term $U'_{vx}$ and the damper velocity for a given $U'_x$ due to the rigid body rotation of the damping brace 124 in the opposite direction of $U'_x$ movement.

Also, $\alpha_v$ which is a measure of the distortion of the internal angle $\beta$ is larger in equation 12 than in equation 6. The larger distortion means that the opposite ends of the damper 122 are pulled further apart along a greater working stroke. The damper is thus called into service to dampen the seismic force to a greater extent than in prior art constructions, where the damper is moved along a shorter stroke.

Figure 8:
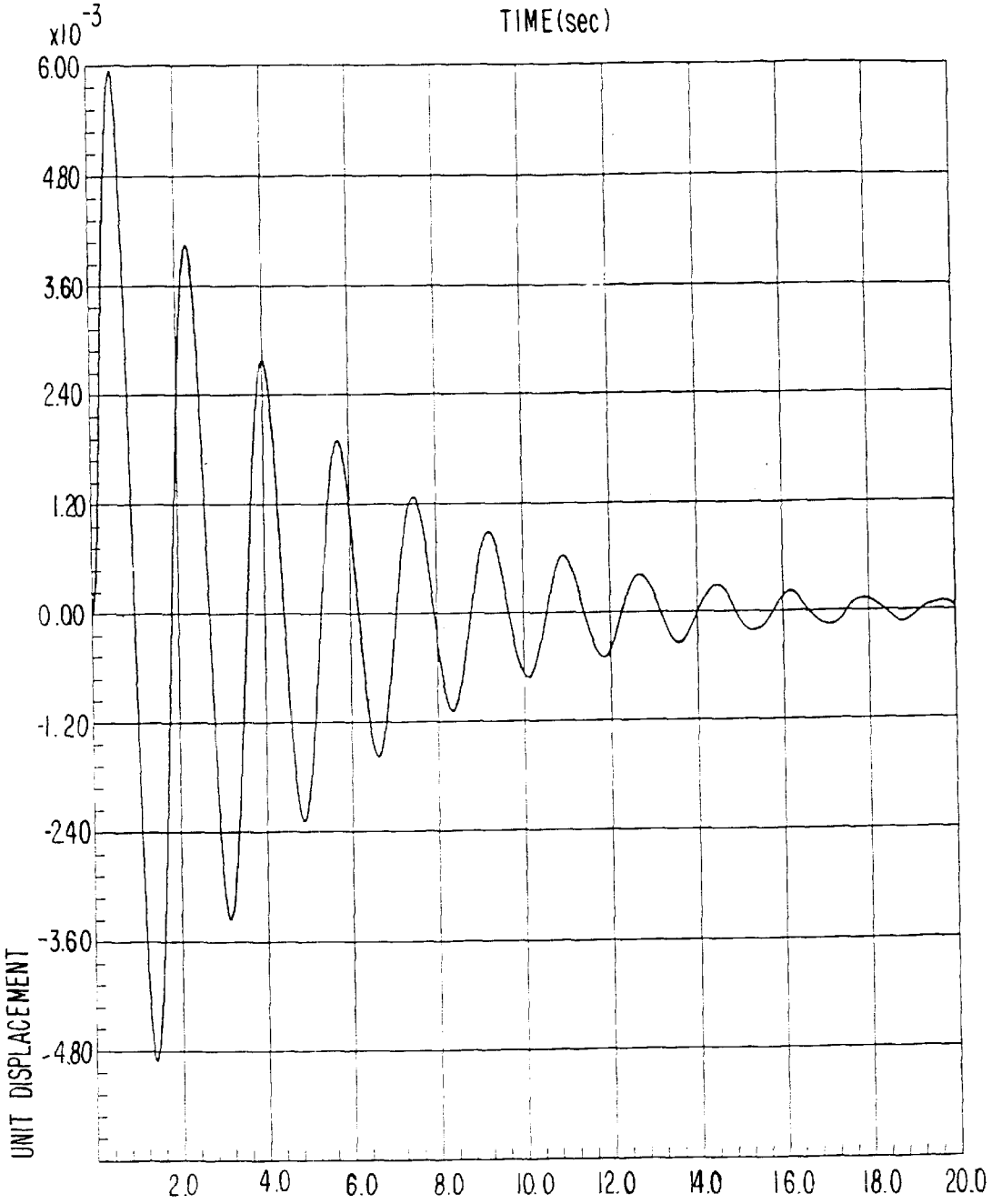
FIG. 8 PRIOR ART
FIG. 8 is a graph depicting the decay rate of lateral displacement of a joint in response to impulse loading according to the prior art.
Figure 9:
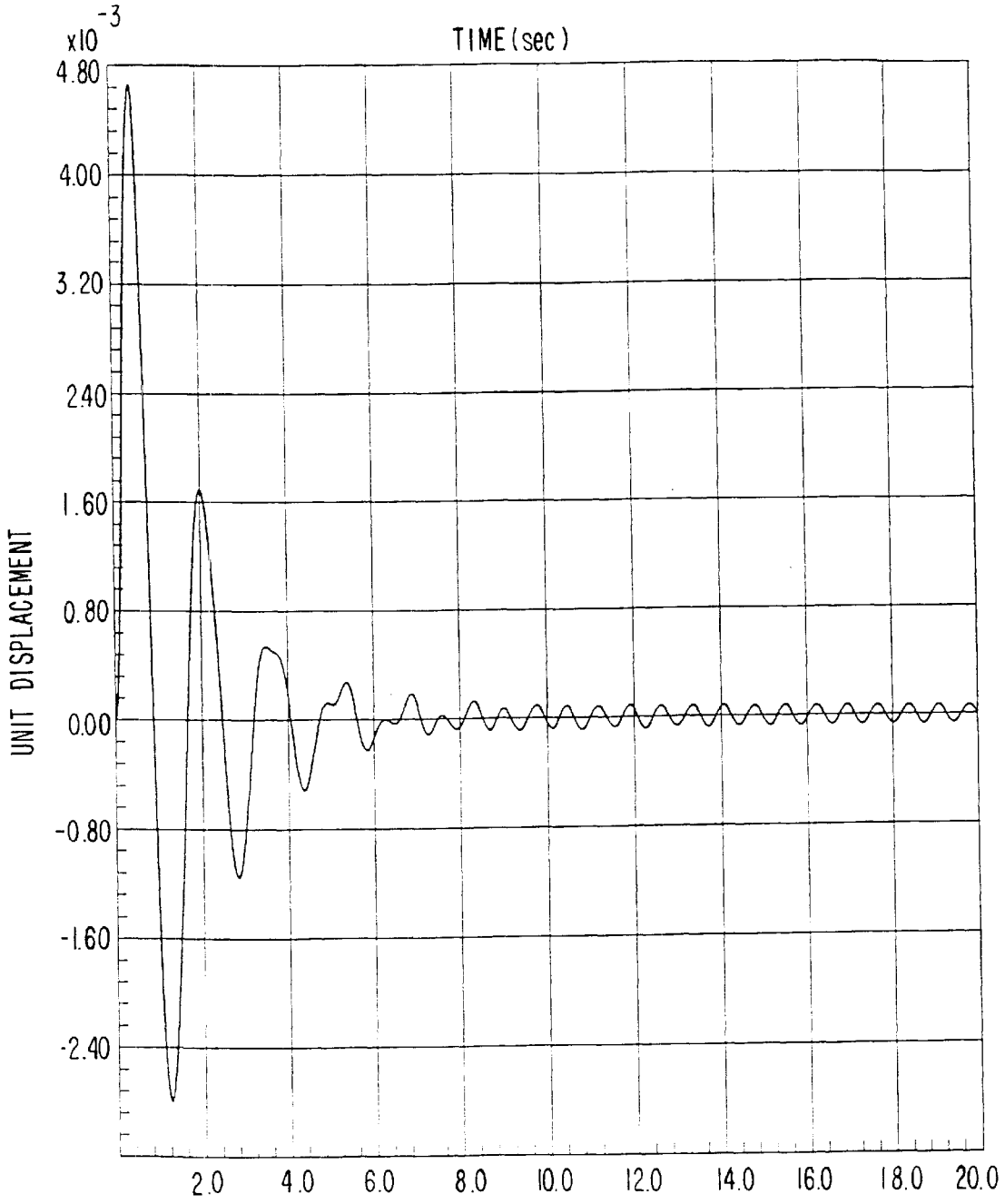
FIG. 9 is a graph analogous to FIG. 8, but in accordance with this invention.

Using a structural analysis program, computer models were created to study the effective damping value obtained by this invention over the prior art. FIGS. 8 and 9 respectively, depict the decay rate of lateral displacement of a joint in response to impulse loading for the prior art and the present invention. A comparison of FIGS. 8 and 9 illustrates the more effective damping achieved by this invention for a given load.

It will be understood that each of the elements described above, or two or more together, also may find a useful application in other types of constructions differing from the types described above.

While the invention has been illustrated and described as embodied in coupled truss systems with damping for seismic protection of buildings, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A system for reducing deflections in an upright structure exposed to external forces, comprising:

a) a pair of upright, triangular framed, truss systems spaced apart from each other, each truss system having a lower end region fixedly secured to a foundation, an upper free end region movable against resistance in a transverse oscillatory cantilever motion in response to the external forces, and a truss column extending from the foundation to the upper free end region, each truss system including a vertically stacked arrangement of integrated truss modules, each module comprising a pair of generally vertical, elongated columns, at least one generally horizontal, elongated beam connected at corner regions to the columns, and a generally diagonal, elongated, stiffening brace connected at opposing corner regions to the columns and said at least one beam; and b) a damping system coupled between the truss systems for minimizing the deflections, said damping system including a damping element movable along a stroke, a pair of nodes respectively connected to the truss columns, said truss columns being vertically and horizontally deformed during the cantilever motion of the truss systems, said vertical deformation of the truss columns being operative for increasing relative movement between the nodes and moving the damping element along a greater stroke.

2. The system according to claim 1, wherein the damping system includes an elongated damper having damper ends movable longitudinally in opposite directions along the stroke during the cantilever motion of the truss systems, and wherein the damper ends are connected to the nodes of one of the modules.

3. A system for reducing deflections in an upright, high-rise, building exposed to external shock forces, comprising:

a) a pair of upright, triangular framed, truss systems spaced apart from each other, each truss system having a lower end region fixedly secured to a foundation, an upper free end region movable against resistance in a transverse oscillatory cantilever motion in response to the external shock forces, and a truss column extending from the foundation to the upper free end region, each truss system including, for each floor, a pair of generally vertical, elongated columns, at least one generally horizontal, elongated beam connected at corner regions to the columns, and a generally diagonal, elongated stiffening brace connected at opposing corner regions to the columns and said at least one beam; and b) a damping system coupled between the truss systems for minimizing the deflections, said damping system including at least one damper having a pair of damper ends respectively connected to the truss columns at nodes that are displaceable relative to each other during the cantilever motion of the truss systems, said at least one damper being located at a selected floor of the building, said truss columns being vertically and horizontally deformed during said cantilever motion, said vertical deformation of the truss columns being operative for increasing relative movement between the nodes.

4. A method of reducing deflections in an upright structure exposed to external forces, comprising the steps of:

a) spacing a pair of upright, triangular framed, truss systems apart from each other, each truss system including a vertically stacked arrangement of integrated truss modules, each module comprising a pair of generally vertical, elongated columns, at least one generally horizontal, elongated beam connected at corner regions to the columns, and a generally diagonal, elongated, stiffening brace connected at opposing corner regions to the columns and said at least one beam;

b) fixedly securing a lower end region of each truss system to a foundation, and enabling an upper free end region of each truss system to move against resistance in a transverse oscillatory cantilever motion in response to the external forces, each truss column extending from the foundation to the upper free end region; and c) coupling a damping system between the truss columns of the truss systems, and connecting a pair of nodes of the damping system to the truss systems, and enabling the nodes to move relative to each other along an enhanced stroke during the cantilever motion of the truss systems.

* * * * *